US005266183A

United States Patent [19]

Dauksher et al.

[11] Patent Number: 5,266,183

[45] Date of Patent: Nov. 30, 1993

[54] METHOD FOR PLATING AN X-RAY MASK

[75] Inventors: William J. Dauksher, Mesa; Douglas J. Resnick, Phoenix, both of Ariz.

[73] Assignee: Motorola, Inc., Schaumburg, Ill.

[21] Appl. No.: 881,111

[22] Filed: May 11, 1992

[51] Int. Cl.[5] ..... C25D 3/48

[52] U.S. Cl. ..... 205/266

[58] Field of Search ..... 205/266

[56] References Cited

PUBLICATIONS

Shih-Liang Chiu et al., "Electrodeposition of low stress gold for x-ray mask", J. Vac. Sci. Technol. B8 (6), Nov./Dec. 1990.

G. E. Georgiou et al., "DC electroplating of sub-micron gold patterns on X-ray masks", SPIE vol. 471 Electron-Beam, X-Ray, and Ion-Beam Techniques for Submicrometer Lithographies III (1984).

W. Chu et al., "Low-stress gold electroplating for X-ray masks", Microcircuit Engineering 91 International Conference on Microlighography, Rome, Italy, 17-19 Sep. 1991 (Poster P1.20).

K. Suzuki et al., "High flatness mask for step and repeat x-ray lithography", J. Vac. Sci. Technol. B4 (1), Jan.-Feb. 1986.

*Primary Examiner*—T. M. Tufariello

*Attorney, Agent, or Firm*—Joe E. Barbee; Rennie William Dover

[57] ABSTRACT

A method for making an x-ray mask having a low-stress absorber layer. A substrate is placed in an electroplating system and an electroplating solution is provided to the electroplating system. The electroplating solution has a gold sulfite based component and a thallium based component. The thallium based component is at a concentration of at least 20 milligrams per liter of electroplating solution. A gold containing absorber layer is electrodeposited onto the substrate. A high concentration of thallium produces an absorber layer insensitive to the brightener concentration in the electroplating solution and having a stress less than approximately $1\times10^8$ dynes/cm$^2$. In addition, the absorber has a small grain size, a low surface roughness, and a low defect density. Thus, the absorber layer is easier to inspect and, if required, to repair.

13 Claims, No Drawings

METHOD FOR PLATING AN X-RAY MASK

BACKGROUND OF THE INVENTION

This invention relates, in general, to x-ray masks and, more particularly, to x-ray masks having an absorber layer of a small grain size, a low-stress, a low surface roughness, and a low defect density.

Typically, masks used in x-ray lithography have an absorber layer patterned over a substrate layer, wherein the substrate layer is only slightly thicker than the absorber layer. The substrate layer must be sufficiently thin to allow transmission of an x-ray electromagnetic signal through exposed portions of the substrate layer. The absorber layer, on the other hand, must be sufficiently thick to prevent the x-ray electromagnetic signal from penetrating the absorber layer. Because the thickness of the absorber layer is of a same order of magnitude as the substrate layer, a high-stress absorber layer may distort or bend the substrate layer. The distortion caused by the absorber layer may produce overlay errors during x-ray lithography as well as delamination of the absorber layer. Further, the absorber layer may have a high surface roughness or a high defect density thereby adversely affecting mask inspection systems during an inspection of the x-ray masks. In addition, x-ray masks having a large grain size militates against repairs of the x-ray mask by ion etching. Accordingly, it would be advantageous to have a low-stress absorber layer with a small grain size, a low surface roughness, and a low defect density.

SUMMARY OF THE INVENTION

Briefly stated, the present invention is a method for making an x-ray mask having a low-stress absorber layer. In addition, the method provides an absorber layer having a small grain size, a low surface roughness, and a low defect density. A gold containing absorber layer having a thickness ranging between approximately 3,000 angstroms and 8,000 angstroms is electroplated onto a substrate. The electroplating solution comprises a gold-sulfite based solution and a thallium solution. The concentration of thallium in the electroplating solution is at least 20 mg of thallium per liter of electroplating solution.

DETAILED DESCRIPTION OF THE INVENTION

It is well known in the semiconductor art that a semiconductor device having sub-micron feature sizes may be fabricated using x-ray lithography. A high resolution of x-ray lithography arises because this technique employs electromagnetic radiation having a wavelength of approximately 10 angstroms. The electromagnetic radiation is either transmitted through uncovered portions of a patterned x-ray mask or absorbed by a material covering a portion of the patterned x-ray mask.

Typically, an x-ray mask comprises a substrate on which an absorbing material is electroplated. It shall be understood that the substrate includes a plating base. The plating base may include, for example, approximately 100 angstroms of titanium and approximately 200 angstroms of gold. It shall be further understood that the plating base is not a limitation of the present invention. Many materials for plating bases are well known to those skilled in the art. The substrate is commonly referred to as a membrane, whereas the absorbing material is commonly referred to as an absorber or an absorber layer. The substrate must be sufficiently thin to allow the electromagnetic radiation to penetrate the substrate. Preferably, the substrate is silicon carbide having a thickness ranging between approximately 8,000 angstroms and 20,000 angstroms. It shall be understood that the substrate material is not a limitation of the present invention; for example, silicon nitride or boron doped silicon may serve as the substrate.

The absorber layer absorbs the electromagnetic radiation, thereby preventing transmission of the electromagnetic radiation through the x-ray mask. Thus, the absorber layer must be thick enough to prevent the electromagnetic radiation from penetrating through the x-ray mask. Typically, a layer of a photoresist is patterned on the substrate and the absorber is electroplated on exposed portions of the substrate. Preferably, the material for the absorber includes a gold component and has a thickness ranging between approximately 3,000 angstroms and 8,000 angstroms.

An electroplating process, also referred to as an electrodeposition process, is performed in an electroplating system or an electrodeposition apparatus. The electroplating system may include a reservoir, a pumping mechanism, a baffle, a fountain cup, an anode, and a cathode. The substrate is mounted to the cathode. An electroplating solution may be pumped from the reservoir, passed the anode, through the baffle, and into the fountain cup. Preferably a flow rate of the electroplating solution ranges between approximately 0 liters per minute and 27 liters per minute, and a temperature at which the electroplating solution is maintained ranges between approximately 20° C. and 60° C. It shall be understood that for a flow rate of approximately 0 liters per minute, the electroplating solution is contained in the fountain cup.

Typically, a substrate is placed in contact with the cathode of the electroplating system. A bias is applied between the anode and the cathode wherein the bias has a current density ranging between approximately 1 milliamp per square centimeter and 12 milliamps per square centimeter. Preferably, the bias is a pulsed current train having a frequency ranging between approximately 10 Hertz and 4,000 Hertz and having a duty cycle of at least 10%. Further, the pulsed current train may be modulated such that the pulsed current train is alternately on and off. For example, the pulsed current train may be on for a time ranging between approximately one and ten seconds, also referred to as an on-time, and off for a time ranging between approximately one millisecond and three seconds, also referred to as an off-time. It shall be understood that the type of bias is not a limitation of the present invention. In other words, the bias may be a DC bias. Application of the bias may form an electric double layer and a diffusion barrier between the anode and the cathode.

An electroplating solution comprises a mixture of a sulfite based gold solution and a solution having a brightener. The electroplating solution is also referred to as a sulfite based plating solution or a sulfite based gold plating solution. In a preferred electroplating solution embodiment, the electroplating solution is a sulfite based plating solution sold under the trademark "SEL-REX" "NEUTRONEX" 309, produced by Enthone-OMI Inc., wherein the "SEL-REX" "NEUTRONEX" 309 includes a "NEUTRONEX" 309 Make-up solution, a "NEUTRONEX" 309 Replenisher solution, and a "NEUTRONEX" 309 Conducting salts solution. Adjustments in pH of the preferred electroplating solution embodiment may be carried out with reagent grade sodium hydroxide(20% by weight) or reagent grade sulfuric acid(5% by volume).

The preferred electroplating solution embodiment comprises gold in a concentration ranging between approximately 10.272 grams per liter and 12.326 grams per liter of electroplating solution, and thallium as a brightener having a concentration of approximately 75 milligrams per liter of electroplating solution. It shall be understood that a minimum concentration of thallium of 20 milligrams per liter of electroplating solution provides acceptable results in reducing absorber layer stress. A high concentration of thallium in the electroplating solution increases a probability of thallium co-depositing with the gold, which may inhibit growth of gold grains and cause dislocations in a metal lattice, thereby reducing absorber layer stress. Further, addition of a high concentration of thallium to the electroplating solution increases an optical reflection from the absorber layer.

In a preferred embodiment, the electroplating solution has a pH of approximately 8.8, and a flow rate through the electroplating system of approximately 15 liters per minute. Further, in the preferred embodiment, a bias is provided as a current pulse train having a current density of approximately 3 milliamps per square centimeter, a frequency of approximately 700 Hertz and a duty cycle of approximately 25%. Further, the on-time of the pulsed current train is approximately ten seconds and the off-time of the pulsed current train is approximately one millisecond; wherein the duration of the bias, also referred to as an electrodeposition time, is approximately three minutes. It shall be understood that in the absence of the bias no appreciable plating occurs while the substrate is in the presence of the electroplating solution.

By now it should be appreciated that there has been provided a method for making a low-stress x-ray mask having a low surface roughness by forming an electroplated substrate. The method employs using a high concentration of thallium in an electroplating solution. The thallium may inhibit grain growth of an electrodeposition material thereby providing an absorber layer comprising gold of a small grain size, and thus decreasing absorber layer stress. The small grain size helps provide a low surface roughness. In addition, the low surface roughness allows deposition of a thinner and more uniform layer of absorber having a low defect density; resulting in an absorber layer which is easier to inspect and subsequently repair.

Moreover, the present invention allows a greater process latitude, commonly referred to as providing a wider process window. For example, prior art processing techniques require brightener concentrations of approximately one to two milligrams per liter of electroplating solution to attain an absorber layer stress of less than approximately $0.2\times10^9$ dynes per square centimeter. Maintaining brightener concentrations in the one to two milligrams per liter of electroplating solution range is difficult in a production environment. Accurate analysis of electroplating solutions containing low concentrations of the brightener is extremely difficult. In addition, the use of other brighteners such as arsenic, is not well controlled since this brightener compound exhibits multiple oxidation states. The present invention provides a film stress of less than approximately $1\times10^8$ dynes per square centimeter, while using a brightener concentration of approximately 75 milligrams per liter of electroplating solution. Moreover, the present invention provides a surface roughness of approximately 250 angstroms, measured from a highest point to a lowest point on a substrate surface. Further, unlike the prior art techniques, a change in concentration of 10 milligrams per liter of electroplating solutions does not affect the stress of the plated solid absorber layer about an operating point. Thus, control of the concentration of brightener in the electroplating solution is much easier.

We claim:

1. A method for plating an x-ray mask wherein the method is insensitive to thallium brightener concentration about an operating point and the method yields an absorber layer having a small grain size, low-stress, low surface roughness, and low defect density, comprising the steps of:

providing an electroplating system capable of accepting an electroplating solution;

placing a substrate in the electroplating system wherein the substrate has a thickness ranging between approximately 8,000 angstroms and 20,000 angstroms;

providing the plating solution to the electroplating system wherein the electroplating solution comprises: a sulfite based gold plating solution having a pH greater than approximately 7 and a temperature ranging between approximately 20° C. and 60° C., and a thallium brightener having a concentration of at least 20 milligrams per liter of electroplating solution; and applying a bias between an anode and a cathode of the electroplating system thereby forming an x-ray mask by forming a plated absorber layer on the substrate.

2. The method for plating an x-ray mask of claim 1 further including providing the bias having a current density ranging between approximately 1 milliamp per square centimeter and 12 milliamps per square centimeter.

3. The method for plating an x-ray mask of claim 1 further including providing the bias as a pulsed current train having a frequency ranging between approximately 10 Hertz and 4,000 Hertz and duty cycle greater than approximately 10%.

4. The method for plating an x-ray mask of claim 1 further including providing the bias as a DC bias.

5. The method for plating an x-ray mask of claim 1 further including providing an on-time of the bias ranging between approximately 1 second and 10 seconds and an off-time of the bias ranging between approximately 1 millisecond and 3 seconds.

6. The method for plating an x-ray mask of claim 1 further including providing the electroplating solution at a flow rate ranging between approximately 0 liters per minute and 27 liters per minute.

7. A method for electrodepositing a low-stress layer comprising gold and thallium on a substrate thereby forming an electroplated substrate capable of use in x-ray lithography, wherein the method is insensitive to thallium concentrations, comprising the steps of:

providing an electrodeposition apparatus;

placing the substrate in the electrodeposition apparatus;

providing a sulfite based plating solution having a pH of at least 7 wherein the sulfite based plating solution comprises gold as an electrodeposition material and thallium having a concentration of at least 20 milligrams per liter of sulfite base plating solution;

pumping the sulfite based plating solution at a flow rate ranging between approximately 0 liters per minute and 27 liters per minute;

applying a pulsed current train bias between an anode and a cathode wherein the pulsed current train bias has a current density ranging between approximately 1 milliamp per square centimeter and 12 milliamps per square centimeter, a frequency ranging between approximately 10 Hertz and 4,000 Hertz, and a duty cycle greater than approximately 10%; and electrodepositing a layer comprising gold and thallium on the substrate having a thickness ranging between 3,000 angstroms and 8,000 angstroms.

8. The method for electrodepositing a low-stress layer of gold of claim 7 further including performing the electrodeposition for approximately three minutes.

9. A method for decreasing absorber stress, absorber surface roughness, absorber grain size, and absorber defect density on an x-ray mask wherein the method increases process latitude with respect to a thallium concentration, comprising the steps of:

providing an electroplating solution wherein the electroplating solution comprises a gold-sulfite based solution and a thallium solution, the electroplating solution having at least 20 milligrams of thallium per liter of electroplating solution; and electroplating a gold containing absorber layer from the electroplating solution onto a substrate, the gold containing absorber layer having a thickness ranging between approximately 3,000 angstroms and 8,000 angstroms.

10. The method for decreasing absorber stress of claim 9 further including providing a pulsed current train bias having a current density ranging from approximately one milliamp to twelve milliamps per square centimeter, a frequency ranging between approximately 10 Hertz and 4,000 Hertz, and a duty cycle greater than approximately 10%.

11. The method for decreasing absorber stress of claim 9 further including providing the electroplating solution having a gold concentration of at least 10.272 grams per liter of electroplating solution.

12. The method for decreasing absorber stress of claim 9 further including providing a pulsed current train on-time ranging between approximately one second and ten seconds, and a pulsed current train off-time ranging between approximately one millisecond and three seconds.

13. The method for decreasing absorber stress of claim 9 further including providing the substrate as silicon carbide.

* * * * *